United States Patent [19]

Peterson et al.

[11] 4,127,063

[45] Nov. 28, 1978

[54] LEATHER MARKING TOOL

[75] Inventors: Rollie V. Peterson, Saugus; Donald L. Peterson, Sylmar, both of Calif.

[73] Assignee: R.D.R. Company, Sylmar, Calif.

[21] Appl. No.: 800,355

[22] Filed: May 25, 1977

Related U.S. Application Data

[63] Continuation-in-part of Ser. No. 613,442, Sep. 15, 1975, abandoned.

[51] Int. Cl.[2] ..... B45B 5/00; C14B 1/56

[52] U.S. Cl. ..... 101/3 R; 101/316; 101/368; 69/20; 279/1 Q; 279/76

[58] Field of Search ..... 101/3 R, 4, 368, 316; 197/6.7; 279/1 Q, 102, 76, 79; 69/20

[56] References Cited

U.S. PATENT DOCUMENTS

| | | | |
|---|---|---|---|
| 951,013 | 3/1910 | Lane | 279/76 UX |
| 2,285,956 | 6/1942 | Weber | 279/1 Q |
| 2,384,707 | 9/1945 | Sweet | 101/3 R UX |
| 2,427,358 | 9/1947 | Kovach | 101/3 R |
| 2,558,616 | 6/1951 | Johnson | 101/3 R |
| 2,661,681 | 12/1953 | Fenstermaker | 101/4 |
| 2,833,548 | 5/1958 | Clark | 279/1 Q |
| 2,851,295 | 9/1958 | Chaffee | 279/76 UX |
| 3,160,090 | 12/1964 | Diegel | 197/6.7 X |
| 3,244,428 | 4/1966 | Röhm | 279/1 Q |
| 3,362,326 | 1/1968 | Delpo et al. | 101/316 |

FOREIGN PATENT DOCUMENTS

| | | | |
|---|---|---|---|
| 731,887 | 6/1955 | United Kingdom | 279/1 Q |

*Primary Examiner*—Clifford D. Crowder

[57] ABSTRACT

An improved leather marking tool which incorporates both the hammer and the punch into a single unit, the improvement being directed to the keying of the drive shaft of the unit in order to prevent rotation and incorporating a structure at the end of the drive shaft which permits such to cooperate with a plurality of different marking heads so marking heads can be used interchangeably.

1 Claim, 6 Drawing Figures

LEATHER MARKING TOOL

CROSS-REFERENCE TO RELATED APPLICATION

This is a continuation-in-part of co-pending application Ser. No. 613,442 filed Sept. 15, 1975 by Rollie V. Peterson and Donald L. Peterson, now abandoned.

BACKGROUND OF THE INVENTION

The field of this invention relates to marking devices and more particularly to a marking device for leather wherein within a single unit the hammer is incorporated with the punch and merely by fully depressing the unit, the hammer then strikes the marking head resulting in the forming of a depression within leather.

The present technique of engraving leather utilizes a mallet and a separate engraving punch. The normal procedure of use is for the punch to be located within a person's hand and the mallet is located within the other hand of the person. The mallet is swung and caused to strike the punch. The striking of the punch causes an impression to be formed in the leather, the male of the impression being formed in the head of the punch. Besides the hobbyist or professional requiring utilizing of both hands, much skill is needed to repeat the image depth from one impression to another.

A substantial number of people that do engraving of leather are handicapped people. Many of these handicapped people have only the use of one hand. Such a person would find it impossible to use a mallet and a separate engraving punch. At the present time there is no known leather marking tool which could be used by a person having only one hand.

SUMMARY OF THE INVENTION

The marking tool of the first embodiment of this invention employs the use of a spring dischargeable hammer which is to be movable against a drive rod when the device is fully depressed. The drive rod is connected to a marking head. The drive rod and the marking head form a conventional type of punch. The drive rod includes an elongated slot forming a keyway. A nose cone surrounds the drive rod and functions as a stop for the outward longitudinal movement of the drive rod. A pin extends through the nose cone into cooperation with the keyway to prevent rotational movement of the drive rod with respect to the nose cone. A detent protrudes through the side wall of the drive rod adjacent its free end thereof, the detent being biased outwardly by a plug of resilient material located within the drive rod. This detent is to cooperate with an opening formed within the marking head and functions to lock the marking head upon the drive rod. The detent is movable inwardly against the resilient block which functions to exert a constant bias upon the detent to the outer position.

The second embodiment of this invention does not employ a detent, but employs a socket member which is threadably secured to the free end of the drive rod. Within the socket member is provided a female opening which is adapted to interconnect with the male end of the marking head. Within the socket opening is located a resilient O-ring and when the male portion of the marking head is located within the opening the resilient O-ring functions to secure the marking head to the socket member. The securement is sufficient to prevent accidental dislodgement of the marking head from the socket member and also prevents rotation of the marking head in respect to the socket member during use.

The primary objective of this invention is to design a single unit marking tool and the marking tools can be interchanged by using only one of the operator's hands. Another primary objective of this invention is to create a tool which is formed into a single unit which will strike the punch with exactly the same force each time it is used. Another significant objective of this invention is that the amount of force can be adjusted prior to use and once a certain amount of force is selected, this force is maintained as long as desired. A further advantage of this invention is that the marking tool is designed to connect with a plurality of different marking tools. A further advantage is that the marking tool cannot be rotated with respect to the housing of the device which eliminates spoiling of the formed design. A further advantage is that by the use of a resilient member instead of using a spring is that corrosion and malfunction is substantially eliminated which would be due to the common presence of moisture and tannic acid which are both present in leather.

DETAILED DESCRIPTION OF THE SHOWN EMBODIMENT

Figure 1:
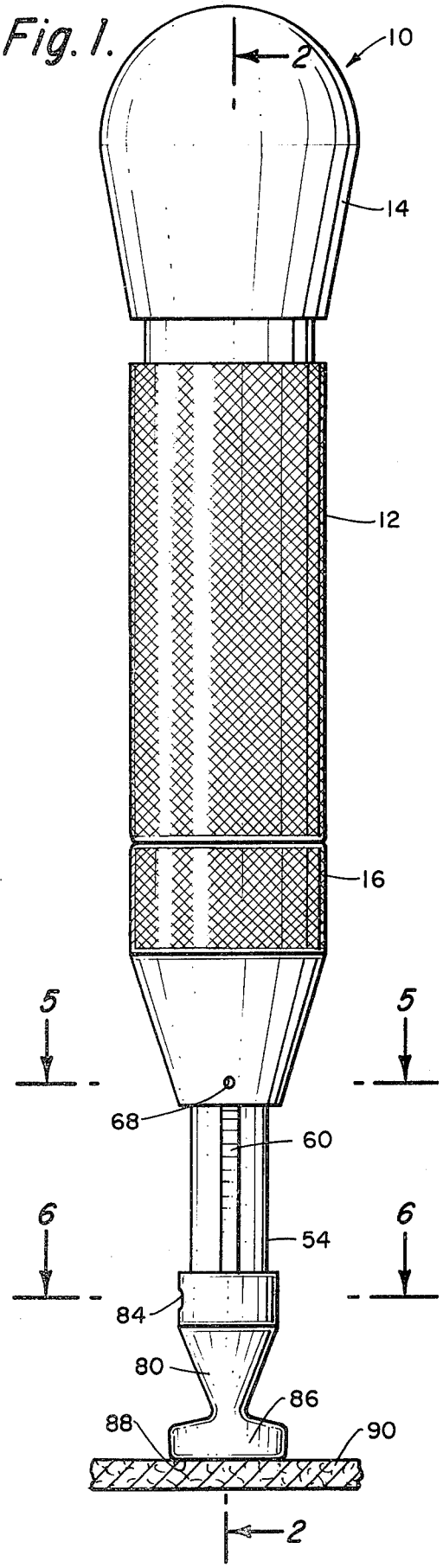
FIG. 1 is an exterior longitudinal view of the marking device of this invention.
Figure 4:
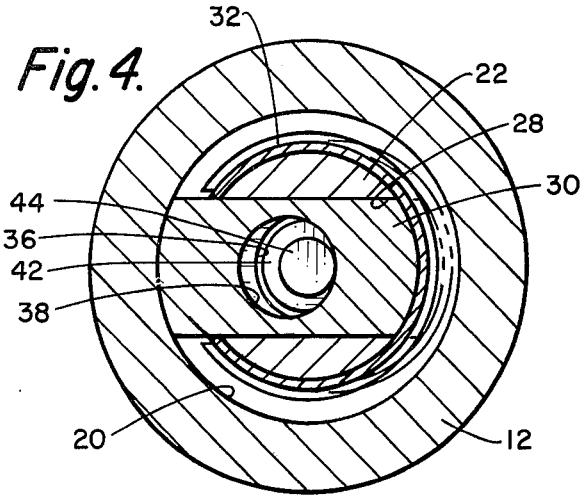
FIG. 4 is a cross-sectional view taken along line 4—4 of FIG. 2.
Figure 5:
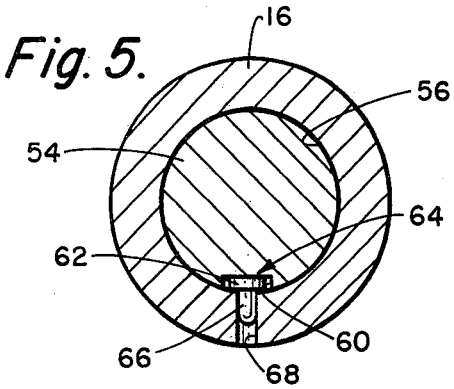
FIG. 5 is a cross-sectional view taken along line 5—5 of FIG. 1.
Figure 6:
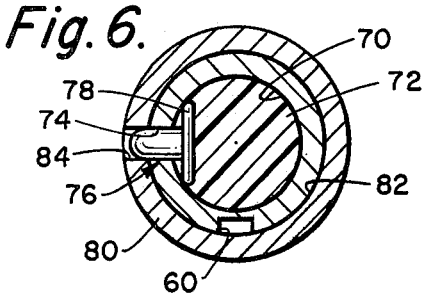
FIG. 6 is a cross-sectional view taken along line 6—6 of FIG. 1.
Figure 2:
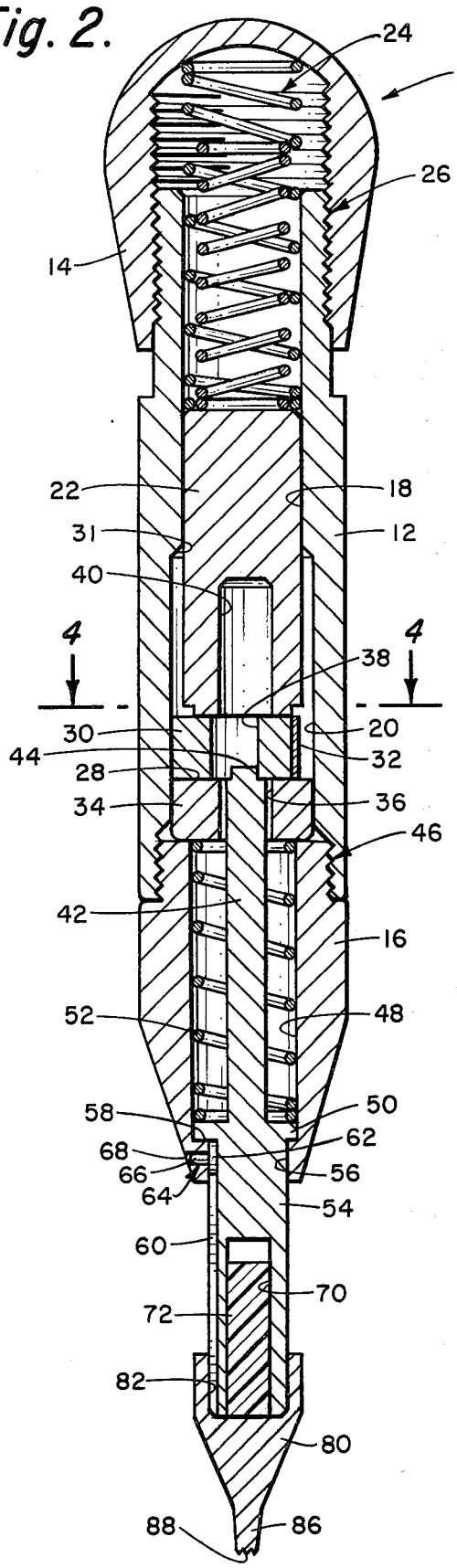
FIG. 2 is a longitudinal cross-sectional view of the marking device of this invention taken along line 2—2 of FIG. 1.

Referring particular to the drawings, there is shown in FIGS. 1 through 6 a marking device 10 of this invention which includes a housing 12, a cap 14 and a nose cone 16. The housing 12 includes a smaller diametered interior chamber 18 and a larger diametered interior chamber 20.

Within the chamber 18 there is slideably mounted a hammer 22. The upper end of the hammer 22 is in contact with a spring assembly 24 which takes the form of two springs, one located inside the other. The spring assembly 24 is in contact with the inside of cap 14. The cap 14 is threadably secured by screw thread assembly 26 to the housing 12.

The lower end of the hammer 22 includes an enlarged transverse slot 28. Within the slot 28 is located a member 30.

A leaf spring 32 is located about the hammer 22 with the spring 32 in contact with one end and only one end of the member 30. This results in the member 30 being under a constant bias to the position shown in FIGS. 2 and 4. The member 30 is located adjacent an enlarged head section 34 which is formed integral with the hammer 22.

A longitudinal opening 36 is formed within the head section 34 which is to be in substantial alignment with longitudinal opening 38 which is formed within the member 30 and which is in substantial alignment with longitudinal opening 40 formed within the hammer 22. These openings 36, 38 and 40 are to cooperate, when aligned, to permit entry of a drive rod 42. The inner end of the drive rod 42 is formed into a smaller diametered section 44. The member 30 is normally in contact with the section 44 when the device of this invention is in an inoperative position.

The nose cone 16 is threadably secured by screw thread assembly 46 to the housing 12. Located within the nose cone assembly 16 is an interior chamber 48. The drive rod 42 extends through the chamber 48. Integrally attached to the drive rod 42 is an enlarged flange 50. The flange 50 cooperates in a close fitting manner within the interior wall of the chamber 48. A return spring 52 is located within the chamber 48 with one end in contact with the flange 50 and the other end in contact with the head section 34.

A main section 54 of the drive rod 42 is integrally secured to the flange 50. The main section 54 extends through opening 56 and the tip of the nose cone 16. The sides of the opening 56 are smaller in diameter than the chamber 48. This results in the flange 50 normally contacting in an at rest position a shoulder 58.

Formed longitudinally within the wall of the main section 54 is a longitudinal keyway 60. The disc shaped base 62 of a key 64 cooperates with the keyway 60. A protuberance 66, which is integrally secured to the base 62, extends with an opening 68 formed within the nose cone 16 in the area of the opening 56. The key 64 functions to prevent rotational movement of the main section 54 with respect to the nose cone 16.

Located within the main section 54 is a longitudinal opening 70. Positioned within the opening 70 is a block 72 of resilient material, such as rubber or the like. Connecting with opening 70 is a transverse opening 74. A detent member 76 is positioned within the opening 74 with the base 78 of the detent member 76 being positioned within the opening 70. The base 78 is in contact with the resilient block 72.

The marking head 80 has an internal opening 82 formed therein. Formed through the wall of the marking head 80 and connecting with the opening 82 is a transverse opening 84. The main section 54 is adapted to extend within the opening 82 and the detent member 76 is to cooperate within the opening 84 thereby securing the marking head 80 to the main section 54. The tip 86 includes an impression type of surface 88. The surface 88 is to be imprinted upon a surface of a piece of leather 90 or other impressible material.

Figure 3:
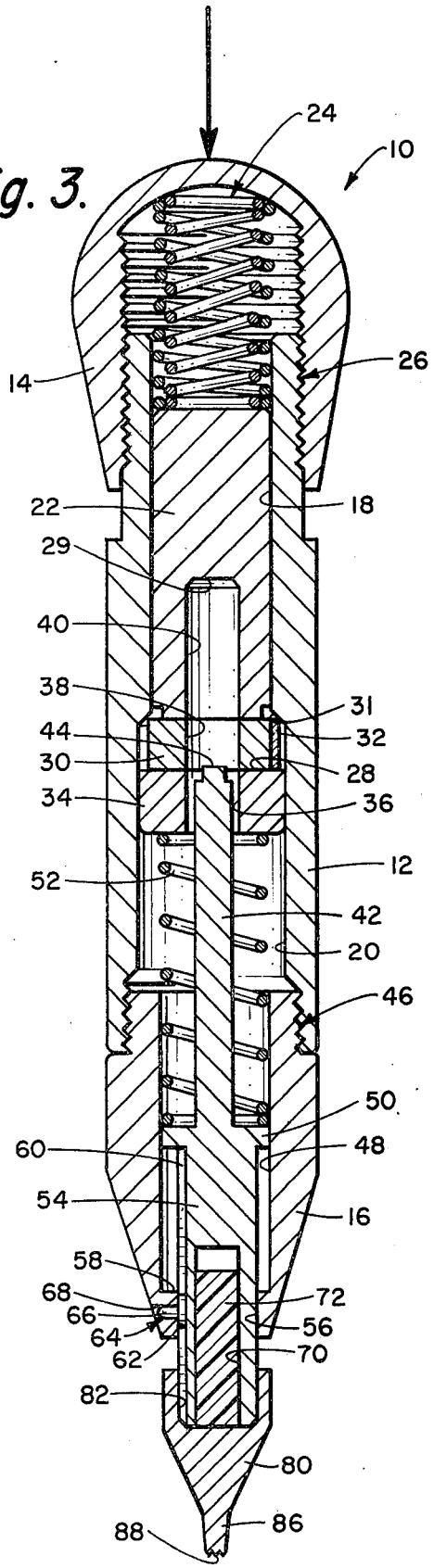
FIG. 3 is a view similar to FIG. 2 but showing the marking device in the fully depressed position in which the hammer has just been released and is in position to move downward against the drive rod which, in turn, exerts a force against the marking head.

The operation of the first embodiment 10 of this invention is as follows: The operator first selects the desired force to be used for a particular marking head 80 by twisting of the cap 14 with respect to the housing 12. The farther cap 14 is threadably secured upon the housing 12, the greater the force. The operator then takes the particular marking head 80 and inserts such on the main section 54 until the detent member 76 cooperates within the opening 84. The detent member is forced inwardly against the resilient plug 72 until the detent member cooperates with the opening 84 at which time it is biased by the resilient plug 72 to the extended position and then located within the opening 84. The operator then presses the impression 88 in its particularly desired location on the surface of the leather 90 and then depresses the apparatus 10 until the nose cone 16 is located adjacent the marking head 80 as shown in FIG. 3 of the drawings. At this time, the pre-selected force of the spring assembly 24 is at its maximum value. In this position, the annular bevel 31 is in contact with the member 30. Further slight movement of the housing 12 forces the member 30 to move against the bias of spring 32. This frees the member 30 from the drive rod 42. The hammer 22 is forced by the bias of spring assembly 24 causing the drive rod 42 to penetrate opening 40. The depth of opening 40 is pre-selected so that when the hammer 22 has moved to almost the fully extended position, the back end 29 of opening 40 will contact the section 44. The hammer force is thus transmitted through the drive rod 42 to the marking member 80 which thereupon causes the impression 88 to be forced into the surface of the leather 90.

It is to be noted that the base 62 of the key 64 is circular in cross-section. This permits the base 62 to rotate within the keyway 60. This rotation minimizes wear between the key 64 and the section 54. In other words, no flattened surfaces will form on the base 62 because it wears evenly thereabout.

Figure 7:
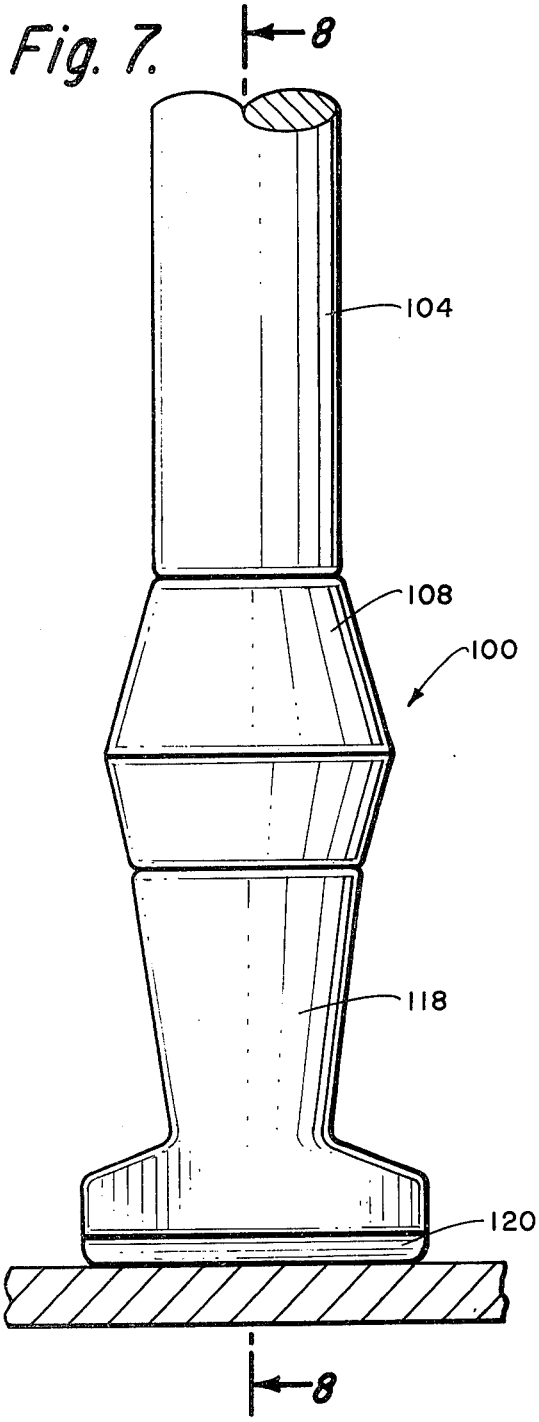
FIG. 7 is an elevational view of a second embodiment of marking device of this invention.
Figure 8:
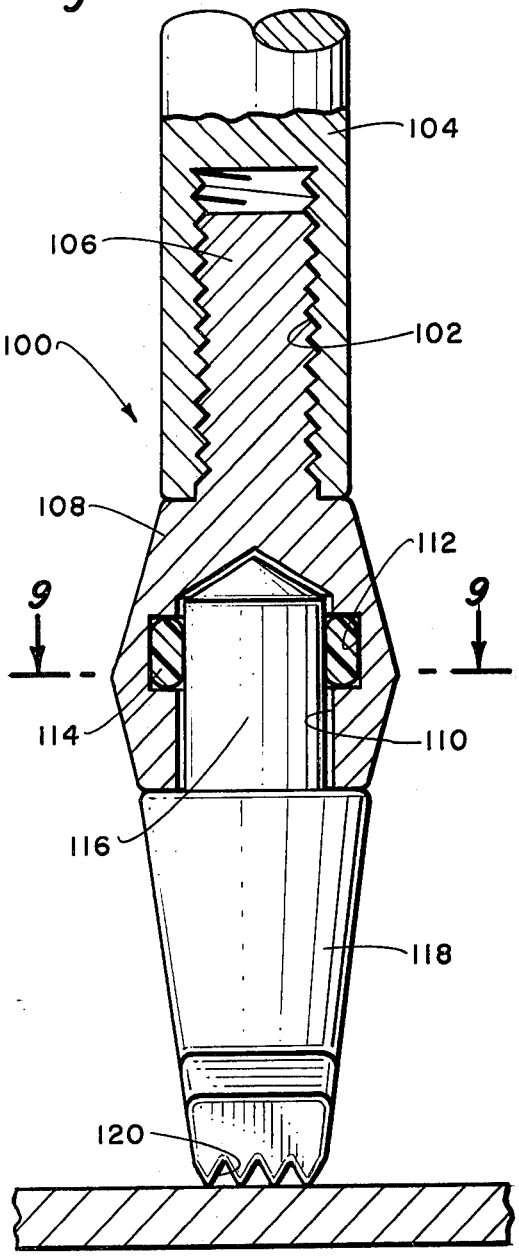
FIG. 8 is a cross-sectional view taken along line 8—8 of FIG. 7.
Figure 9:
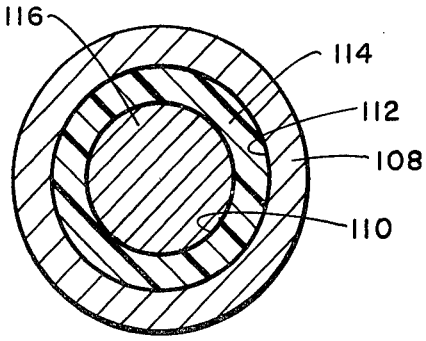
FIG. 9 is a cross-sectional view taken along line 9—9 of FIG. 8.

Referring particularly to FIGS. 7 to 9 of the drawings, there is shown a second embodiment 100 of this invention. The second embodiment 100 has an internal threaded opening 102 within the drive rod 104. Threadably secured within the opening 102 is end 106 of a socket member 108. The socket member 108 includes an internal female opening 110. Located within the wall of the opening 110 is an annular groove 112. Within groove 112 is to be located a resilient (rubber) O-ring 114.

A male plug 116 is to be rotatable within the opening 110 in a substantially close fitting manner. The plug 116 is integrally attached to a marking head 118 which includes an impression 120 similar to the impression 88 previously described. With the plug 116 inserted within the opening 110, the O-ring 114 is outwardly, radially deflected. The deflection is sufficient to frictionally secure the marking head 118 to the socket member 108. The securement is sufficient to prevent accidental dislodgement of the marking head 118 and also prevent rotation of the marking head 118 with respect to the socket member 108 during use.

It is to be understood that the use of the second embodiment 100 is identical to the use of the first embodiment 10.

What is claimed is:

1. A marking apparatus comprising:

a housing having an internal chamber;

a hammer movably mounted within said internal chamber;

a drive rod mounted within said chamber and having one end selectively contactable by said hammer for marking;

a marking head connected by detent means to the other end of said drive rod, said detent means permitting quick and easy removal of said marking head from said drive rod and replacement with another said marking head, said detent means comprising a detent pin movably mounted in respect to said drive rod, biasing means connected to said detent pin to exert a continuous bias upon said detent pin to an extended position, said biasing means comprises a block of resilient material, said block of resilient material being located in a longitudinal opening formed within said drive rod, said detent pin in the extended position to be located within a transverse opening formed in said marking head securing said marking head to said drive rod preventing not only accidental dislodgement of said marking head but also rotation of said marking head relative to said drive rod;

anti-rotation means interconnecting said housing and said drive rod, whereby said drive rod is prevented from rotational movement in respect to said housing;

a longitudinal keyway formed upon said drive rod, a key fixedly secured to said housing connecting with said keyway, said key permitting longitudinal movement of said drive rod with respect to said housing but not permitting rotational movement between said drive rod and said housing; and said key including a base which is circular in shape in cross-section, said base located within said keyway, said base being rotatable within said keyway to thereby minimize wear of said key due to repeated longitudinal movements of said drive rod during use of said apparatus.

* * * * *